United States Patent [19]

Zoleski et al.

[11] Patent Number: 4,479,882

[45] Date of Patent: Oct. 30, 1984

[54] MARINE DIESEL CYLINDER OILS CONTAINING POLYALKOXYLATED PHENOXY COMPOUNDS FOR IMPROVED SPREADABILITY

[75] Inventors: Benjamin H. Zoleski, Beacon; Rodney L. Sung, Fishkill, both of N.Y.

[73] Assignee: Texaco Inc., White Plains, N.Y.

[21] Appl. No.: 458,583

[22] Filed: Jan. 17, 1983

Related U.S. Application Data

[63] Continuation-in-part of Ser. No. 268,954, Jun. 1, 1981, abandoned.

[51] Int. Cl.[3] ..... C10M 1/40

[52] U.S. Cl. ..... 252/33.4; 252/52 A

[58] Field of Search ..... 252/52 R, 52 A, 33.4

[56] References Cited

U.S. PATENT DOCUMENTS

| | | | |
|---|---|---|---|
| 2,493,483 | 1/1950 | Francis et al. | 252/49.5 X |
| 2,681,315 | 6/1954 | Tonberg et al. | 252/52 R X |
| 3,019,187 | 1/1962 | Panzer et al. | 252/52 R X |
| 3,123,570 | 3/1964 | Bonner et al. | 252/52 R X |
| 3,390,083 | 6/1968 | Lion | 252/33.4 |
| 3,872,048 | 3/1975 | Brown | 252/52 R X |
| 3,933,662 | 1/1976 | Lowe | 252/33.4 |
| 4,138,347 | 2/1979 | Crawford | 252/52 A X |

OTHER PUBLICATIONS

Hori et al., "Spreadability of Marine Diesel Engine Cylinder Oils on a Glass Surface at High Temperatures", Lub. Eng., 2/77, pp. 83–90.

*Primary Examiner*—Andrew Metz

*Attorney, Agent, or Firm*—Robert A. Kulason; Robert Knox, Jr.; James J. O'Loughlin

[57] ABSTRACT

The spreadability of marine diesel cylinder oils is improved by the incorporation therein of a spreadability improving amount of a polyalkoxylated phenoxy compound having the formula:

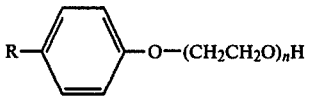

wherein R is an aliphatic hydrocarbyl group having from 5 to 70 carbon atoms and n ranges from 14 to 30.

2 Claims, No Drawings

MARINE DIESEL CYLINDER OILS CONTAINING POLYALKOXYLATED PHENOXY COMPOUNDS FOR IMPROVED SPREADABILITY

CROSS-REFERENCE TO CO-PENDING APPLICATION

This application is a continuation-in-part of our previous coassigned application, Ser. No. 268,954, filed June 1, 1981, and now abandoned.

FIELD OF THE INVENTION

This invention relates to the novel use in a new environment of a special nonionic detergent to improve the spreadability characteristics of a marine diesel cylinder oil by a strictly physical action. The invention relates also to a process for lubricating marine diesel engine cylinders.

As is well known, the main purpose of a lubricant is to provide a fluid film between moving metal surfaces to prevent metal-to-metal contact. Any portion of the metal surface not covered by the lubricant is a potential site for severe wear, scuffing and corrosion to take place. Premature wear, scuffing or corrosion will necessitate the replacement of parts sooner than normal, resulting in increased maintenance costs. Furthermore, any wear debris can cause damage in other parts of the engine.

In marine diesel engines, particularly the cross-headed type, which uses a separate oil system to lubricate the upper cylinder chamber (piston, rings and cylinder liners) where combustion occurs, the ability of the lubricant to cover all metal surfaces adequately and quickly is of paramount importance. The ability of a lubricant to cover a metal surface is known as its "spreadability" characteristic, which also measures its effectiveness in use.

The method used to lubricate the upper cylinder area of a cross-headed marine diesel engine consists of injecting the lubricant into the cylinder through a series of orifices (quills) that are located around the upper circumference of the cylinder. As the lubricant is injected it runs down and across the cylinder liner providing a film over the surface that should prevent metal-to-metal contact between the cylinder liner, piston rings and piston skirt as the piston travels in the combustion chamber.

The problem addressed by the present invention is based on the observation that in many instances the lubricant does not cover the entire cylinder liner surface, leaving dry spots that are potential wear sites. Usually, the area directly under the quills is covered with an oil film but the area adjacent to the quills is dry because of the oil's poor spreadability.

One method of improving the spreadability of oil over the cylinder liner would be to redesign the injector/quill system. This approach would not only be impractical but would be economically prohibitive. Another means of improving spreadability would be to use a lower viscosity lubricant. However, since marine engines are designed to use SAE 50 grade cylinder oils for proper film strength, a lower viscosity product would not support the stresses occurring in this area of the engine and film breakage might be greater than desired, leaving additional areas of unprotected metal.

Another factor to consider is the increased use of high sulfur oils requiring the spreadability of lubricants to be such that they can be readily dispersed on diesel cylinder surfaces to neutralize acidic combustion products, thus preventing costly cylinder and piston ring corrosion and damage.

BACKGROUND OF THE INVENTION

The art relevant to this invention includes U.S. Pat. Nos. 2,493,483; 2,681,315; 3,019,187; 3,123,570; 3,390,083; 3,872,018; 3,933,662 and 4,138,347. The first of these patents discloses a marine engine lubricant capable of forming stable emulsions when in contact with an aqueous medium and comprising a glyoxalidine, a metal sulfonate, a partial ester of polyhydric alcohols and a higher fatty acid having at least 10 carbon atoms with the ester having at least one free hydroxy group, the balance being a mineral oil. The purpose of the lubricant is to render harmless moisture present in steam engines by forming stable water-in-oil emulsions and it thus operates by a physicochemical phenomenon. U.S. Pat. No. 2,681,315 describes the use in a lubricant of a alkylphenoxy polyethoxyethanol having from 2–6 ether groups together with a calcium petroleum sulfonate and an alkaline earth metal salt of an alkylphenol sulfide to improve the anti-rusting properties of the oil. U.S. Pat. No. 3,019,187 describes lubricating oils containing alkyl phenoxy polyoxyethylene alcohols and ethers containing from 5–30 ethyleneoxy substituents which in combination with other additives improve the load-carrying ability of the lubricant. U.S. Pat. No. 3,123,570 describes the use of alkylphenol polyoxyethanols containing from 7 to 9 ethyleneoxy groups to improve the detergency of the lubricant. U.S. Pat. No. 3,390,083 describes the use of a blocked polyester in conjunction with dimer acids and overbased alkaline earth metal sulfonates in a lubricant for marine diesel engine upper cylinders. The patent states that a lubricant suitable for use in marine diesel engines upper cylinders of engines operating on high sulfur fuel oil must be spreadable and wettable on the pistons, the piston rings and the internal surfaces of the cylinder while remaining there under the pressures that the piston rings exert against the cylinder linings. The patent, however, only ascribes to its composition the properties of inhibiting or minimizing wear between frictional surfaces of metals without ascribing improved spreadability either to blocked polyesters alone or their combination with dimer acids. U.S. Pat. No. 3,872,048 describes lubricants which prevent the corrosion of metal surfaces when exposed to water and containing cresoles and a polyoxyethylenealkylaryl ether which is the reaction product of ethyleneoxide and nonylphenol in a ratio of between 3 to 1 and 7 to 1. The patented composition prevents corrosion by two mechanisms, the application of a film of inhibitor on metal surfaces and the encapsulation of the corrosive medium, water, in a stable water-oil emulsion.

U.S. Pat. No. 3,933,662 reports that polyalkoxylated phenoxy compounds in combination with alkaline earth metal carbonates provide rust and corrosion protection in an oil. As reported in Column 2, lines 30–33 of the patent, the polyalkoxylated compounds act by a chemical phenomenon to neutralize acid from an aqueous phase mixed with a lubricant oil.

U.S. Pat. No. 4,138,347 indicates that adducts of nonyl phenol and ethyleneoxide wherein the ethyleneoxy groups range from 1 to 9.5 have a dispersing and/or solubilizing action on overbased calcium sulfonates in 100 percent synthetic diester base lubricants.

As above indicated the above patents deal with the chemical effect of polyalkoxylated compounds but do not ascribe any physical effects thereto, such as spreadability.

SUMMARY OF THE INVENTION

The invention provides marine diesel oils of improved spreadability owing to the incorporation therein of at least one polyalkoxylated phenoxy compound having the formula:

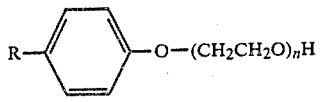

wherein R is an aliphatic hydrocarbyl group having from about 5 to about 70 carbons; n ranges from 10 to 30, preferably 15–25, more preferably 15–20, most preferably 20. It has been found that where n is 9 or lower, or, higher than 30 the compounds are not effective for the purposes of the invention.

In addition to the substituent R, the phenyl moiety of the compounds can have one or more of their substitutable hydrogens replaced by non-interfering groups such as halo, nitro, cyano, trihaloalkyl, hydroxy. Such substituted compounds are fully equal to their non-substituted analogs for the purposes of this invention.

Analogous compounds where the ethyleneoxy group is replaced by a propyleneoxy group are equivalent to the compounds of the above formula for the purposes of this invention as long as their molecular weights correspond to the molecular weights of the preferred ethyleneoxy compounds.

The invention also provides a process for improving the spreadability of a marine diesel engine cylinder oil by incorporating therein at least 0.5 weight percent thereof of at least one of the above compounds.

The invention additionally provides a process for lubricating the moving metal surfaces of a marine diesel engine cylinder by preventing their metal-to-metal contact with a film of the improved oils of the present invention.

DISCLOSURE

The hydrocarbon base oil conventionally employed to prepare the cylinder lubricating oil composition of the invention includes naphthenic base, paraffinic base and mixed base mineral oils, lubricating oil derived from coal products and synthetic oils, e.g., alkylene polymers such as polypropylene and polyisobutylene of a molecular weight of between about 250 and 2500. Advantageously, a lubricating base oil having a lubricating oil viscosity SUS at 100° F. of between about 50 and 1500, preferably between about 100 and 1200, are normally employed for the lubricant composition. The most preferred lubricating viscosity for a cylinder lubricating oil composition is a viscosity ranging from about 68 to 108 SUS at 210° F. The hydrocarbon oil will generally constitute from about 80 to 90 weight percent of the total lubricating oil composition with the preferred concentration range being from about 82 to about 88 weight percent.

The spreadability component of the cylinder lubricating oil composition of the invention is effective in a range from about 0.2 to 5 weight percent based on the total lubricating oil composition. In general, it is preferred to employ from about 0.5 to 2 weight percent of the glycol with the most preferred concentration ranging from about 0.75 to 1.5 weight percent.

The nature of the basic detergents and dispersants added to the oil to give it a TBN ranging from 50 to 100 is not critical. A mixture of 10 to 30 percent by weight of an overbased calcium sulfonate and a sulfurized overbased or normal calcium carbonate can be used.

The overbased calcium sulfonate used has a Total Base Number ranging from 300 to 450 on an active material or neat basis. This component is employed in the finished cylinder lubricating oil at a concentration ranging from 10 to 20 weight percent based on the weight of the lubricating oil composition. A preferred overbased calcium sulfonate has a TBN ranging from about 350 to 425, a preferred concentration of the sulfonate in the lubricating oil is from about 12 to 18 weight percent and a preferred TBN for the lubricating oil composition is from 60 to 80. Total Base Number (TBN) is a measure of alkalinity determined according to the test procedure outlined in ASTM D-664.

The overbased calcium sulfonates can be derived from sulfonic acids or particularly from petroleum sulfonic acids or alkylated benzene sulfonic acids. Useful sulfonic acids from which the overbased calcium sulfonates are prepared can have from about 12 to 200 carbon atoms per molecule. Examples of specific sulfonic acids include mahogany sulfonic acid, petrolatum sulfonic acids, aliphatic sulfonic acids and cycloaliphatic sulfonic acids. Particularly useful alkylated benzene sulfonic acids include polybutylbenzene sulfonic acid, polypropylbenzene sulfonic acid and copolymeric propyl 1-butylbenzene sulfonic acids having molecular weights ranging from about 400 to 900.

The overbased calcium carbonates are produced by neutralizing the sulfonic acid with a calcium base to form a calcium sulfonate salt and then overbasing the calcium sulfonate with calcium carbonate generally by passing carbon dioxide through a mixture of the neutral calcium sulfonate, mineral oil, lime and water. Methods for preparing overbased calcium sulfonates are disclosed in U.S. Pat. No. 3,779,920 and U.S. Pat. No. 4,131,551 and the disclosures in these references are incorporated herein by reference.

SPREADABILITY TEST METHOD

The compositions of this invention are tested by measuring the diameter (mm) of a drop of oil after a predetermined time that drop has been placed on a heated plate. As the drop diameter increases, the spreadability of the lubricant is improved. This procedure gives results which correlate with the performance of engine oils in the cylinder lubrication of cross-head type marine diesel engines.

The apparatus used in this method includes heating means such so that the temperature of a test panel can be controlled at 250±5° C. (unless otherwise specified). The panel coker specified in Federal Test Method Standard No. 791a, Method 3462 can be used. Also required are a microsyringe of 10±0.5 microliter capacity, needle exchangeable type; and calipers. The materials and reagents used are as follows: a test panel of gray iron castings conforming to JIS G 5501, Class FC-20, or ASTM A 48, Class No. 30; 50 by 50 by 5 mm, pierced with two holes, one of 2 mm in diameter and 25 mm in depth at the center of thin surface to insert a thermocouple, and another of 1 mm in diameter at an edge for suspension in washing liquid; waterproof abrasive papers (silicon carbide, 400, 600 and 800 grit); petroleum either having a distillation range of 30°–80° C. or an equivalent refined naphtha; benzene and methyl alcohol.

In brief, the apparatus is prepared for use as follows: one surface of the test panel is polished by pushing and moving round it a 400 grit abrasive paper placed on a flat surface. It is subsequently polished the same way with 600 and 800 grit abrasive paper. Each polishing stage is continued until the disappearance of coarse scratches made in the preceding polishing stage. The test panel is washed after first removing dust using a gauze wet with petroleum ether. A wire is fastened to the hole at the edge of the test panel and same is suspended and dipped first into a beaker of hot benzene then in one of hot methyl alcohol, both boiling on a hot water bath, for one to two minutes respectively. After removing the test panel, it is immediately dried with hot air.

The microsyringe is washed several times with petroleum ether after detaching its needle. The plunger is then removed and the inside surface of the syringe is dried. It is washed twice with the sample to be tested, detaching the needle on intake and replacing it on discharging.

In performing the test, the test panel is placed on the heating block of the heating apparatus which is kept horizontal. Care must be exercised not to touch the surface of the test panel during the test. Next, the test sample is drawn slowly into the syringe to avoid the formation of an air bubble. The microsyringe is set vertically above the polished and washed surface of the test panel with a clearance of about 1 mm. In about 5 minutes, the test panel is heated to 250° C. While maintaining the temperature of the test panel at 250 +5° C. (or at any other desired temperature), 10 microliters of sample are dropped on the panel. One minute after dropping, the diameter of the sample film is measured and recorded to the nearest 1 mm. If the sample film is elliptical, the longest diameter is measured; if the film juts out irregularly, the jutted out portion is not measured. When the sample film turns out to be too irregular, the determination is rejected and the procedure is repeated. Two separate determinations are conducted for each sample. If their individual values differ from more than 10 percent of their mean, two other determinations are carried out.

The values for two separate determinations are averaged to the nearest 1 mm. and the average is reported as the spreadability.

EXAMPLES

The invention is further illustrated in non-limiting fashion by the following examples.

Example 1 involved blending at ambient temperature a polyalkoxylated phenoxy compound where n is 20, (Chemcol NPE 200) in an SAE 50 diesel engine cylinder lubricant. As determined by the test above described, this lubricant alone has a spreadability value of 14.1 mm.

Table I below shows the base blend composition. Adding 2% of the above polyalkoxylated phenoxy compound having 20 ethoxy groups thereto increases the drop diameter from 14.1 to 31.5 mm. for an improvement of 123%.

TABLE I

| Base Blend Composition, Wt. % | |
|---|---|
| Base Oil 30* | 40.90 |
| Base Oil 50* | 30.20 |
| Alkaline Detergent[1] | 8.80 |
| Alkaline Detergent[2] | 17.00 |
| Alkaline Dispersant[3] | 3.10 |
| **Spreadability Test (Example 1)** | **mm** |
| Base Blend | 14.1 |
| Base Blend plus 2 wt. % additive of invention (20 ethoxy groups) | 31.5 |

*SAE grade of solvent refined, paraffinic mineral oil
[1]Calcium carbonate overbased (400 TBN) calcium sulfonate
[2]Sulfurized $CO_2$ blown, double neutralized normal calcium alkylphenolate
[3]Mixed alkenylsuccinimides To demonstrate the criticality of the actual number of ethyleneoxy groups in the additive necessary to provide spreadability other similar compounds having a number of such groups falling outside the scope of the invention were tested as above in an oil having a composition giving it a spreadability of 22.9 mm. The results were as follows:

TABLE II

| Example | Compound | Spreadability (mm) |
|---|---|---|
| 2 oil + | 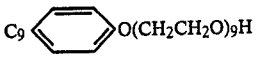 | 26.3 |
| 3 oil + | 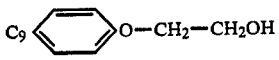 | 19.2 |
| 4 oil + | 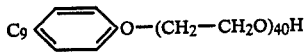 | 21.3 |
| 5 oil | Blend without additive | 22.9 |

Examples 1–5 contained basic detergents and dispersants in an amount sufficient to give the oil a TBN of 50 to 100.

The data of the above Table II thus show that where the ethyleneoxy content of the subject compounds lies outside the specified range of 10 to 30, the spreadability of an oil containing them is not improved and in fact where n is 1 or 40 it is adversely affected (within experimental error).

Obviously, numerous modifications and improvements of the present invention are possible in the light of the above disclosure. Therefore the invention may be practised otherwise than as specifically described herein within the scope of the appended claims.

We claim:

1. A process for improving the spreadability of a diesel engine cylinder mineral oil lubricant having a total base number ranging from about 50 to about 100 due to the presence therein of effective amounts of alkaline detergent-dispersants including overbased calcium sulfonates and carbonates which comprises blending with said lubricant from 0.5 to 2 weight percent thereof of at least one compound represented by the formula:

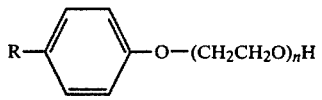

wherein R is an aliphatic hydrocarbyl group having from 5 to 70 carbon atoms and n is 20.

2. A process for lubricating the moving metal surfaces of a marine diesel engine cylinder which comprises causing a film of a mineral oil having a total base number ranging from about 50 to about 100 due to the presence therein of effective amounts of conventional alkaline detergent-dispersants including overbased calcium sulfonates and carbonates to spread on said surfaces by incorporating in said mineral oil a spreadability improving amount of at least one nonionic detergent represented by the formula:

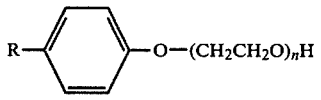

wherein R is an aliphatic hydrocarbyl group having from 5 to 70 carbon atoms and n is 20.

* * * * *